US006311872B1

(12) United States Patent
Bongiovanni

(10) Patent No.: US 6,311,872 B1
(45) Date of Patent: Nov. 6, 2001

(54) HAND-HELD DISPOSABLE DISPENSER FOR POWDER

(76) Inventor: John R. Bongiovanni, 2234 Jericho Turnpike, New Hyde Park, NY (US) 11040

( * ) Notice: Subject to any disclaimer, the term of this patent is extended or adjusted under 35 U.S.C. 154(b) by 0 days.

(21) Appl. No.: 09/176,287

(22) Filed: Oct. 21, 1998

(51) Int. Cl.[7] ..... B67B 5/00; A47G 19/24; B65D 47/00

(52) U.S. Cl. ..... 222/153.05; 222/565

(58) Field of Search ..... 222/565, 480, 222/153.05, 153.07, 541.9, 107; 229/206

(56) References Cited

U.S. PATENT DOCUMENTS

| | | | | |
|---|---|---|---|---|
| 1,087,469 | * | 2/1914 | Stern | 222/565 |
| 3,388,836 | * | 6/1968 | Otto et al. | 222/480 |
| 4,372,098 | * | 2/1983 | Mason | 53/412 |
| 4,591,091 | * | 5/1986 | Wise | 229/17 G |
| 4,638,911 | * | 1/1987 | Prohaska | 206/484 |
| 4,706,875 | | 11/1987 | Blackman | 206/626 |
| 4,815,602 | * | 3/1989 | Schirmer | 206/484 |
| 4,828,130 | | 5/1989 | Hofman | 215/317 |
| 5,022,566 | | 6/1991 | Song et al. | 222/480 |
| 5,145,111 | | 9/1992 | Giblin | 229/219 |
| 5,380,110 | * | 1/1995 | Festa | 222/107 |
| 5,452,850 | | 9/1995 | Allsop | 229/219 |
| 5,579,961 | | 12/1996 | Zimmerman | 222/545 |
| 5,598,927 | * | 2/1997 | Ikenoya et al. | 206/484 |

* cited by examiner

*Primary Examiner*—Andres Kashnikow
*Assistant Examiner*—Davis Hwu
(74) *Attorney, Agent, or Firm*—Richard L. Miller

(57) ABSTRACT

A hand-held disposable dispenser for powder that includes a container for containing the powder and a cover layer releasably attached to the container, and when opened, allowing for dispensing of the powder. The container includes a bottom layer, an intermediate layer that overlies the bottom layer, and a top layer. The top layer overlies spacingly the intermediate layer, with only the perimeter of the top layer being attached to the perimeter of the bottom layer, and thereby forms with the intermediate layer of the container, a compartment for containing the powder, and has a plurality of throughbores for dispensing the powder. The cover layer releasably overlies the plurality of throughbores in the top layer and has an adhesive layer thereon that detachably engages the top layer, a tab that extends radially therefrom for facilitating removal of the cover layer, and a string that extends along and past the tab for further facilitating removal of the cover layer, with the cover layer being removed by first grasping the string and the tab, then pulling upwardly until the cover layer is completely removed from the top layer, exposing the plurality of throughbores in the top layer, and then finally temporarily relocating the cover layer to another area of the top layer.

5 Claims, 1 Drawing Sheet

HAND-HELD DISPOSABLE DISPENSER FOR POWDER

BACKGROUND OF THE INVENTION

1. Field of the Invention

The present invention relates to a hand-held disposable dispenser. More particularly, the present invention relates to a hand-held disposable dispenser for powder.

2. Description of the Prior Art

Numerous innovations for dispensers have been provided in the prior art that will be described. Even though these innovations may be suitable for the specific individual purposes to which they address, however, they differ from the present invention.

A FIRST EXAMPLE, U.S. Pat. No. 4,706,875 to Blackman teaches a vending and reclosure device for powder and granular products. The device is formed of two container panels disposed in overlying relation with respect to each other with an inner one of the two panels having dispensing openings therethrough and the outer one of the panels having formed therein a closure flap which is normally initially free at one end and is connected to the outer panel along sides thereof by way of zig-zag lines of weakening which, when ruptured permit the closure flap to be pivoted at a hinged end thereof out of the plane of the outer panel and away from overlying relation with respect to the dispensing openings in the inner panel. The inner panel is provided with cut lines generally aligned with the lines of weakness. When the closure flap is removed the lines of weakness define pointed projections along the opposite sides thereof and the cut lines in the inner panel define shoulders behind which the projections can lock.

A SECOND EXAMPLE, U.S. Pat. No. 4,828,130 to Hofmann teaches a lid or a cap in particular for spice shakers consisting of a lid bottom and a wall which encircles the lid bottom and projects downwardly therefrom at a substantially perpendicular angle. The inwardly directed face of the wall is provided with ribs which extend in the axial direction of the shaker, are spaced apart from each other and which when the lid is fitted to the shaker and when the lid is removed from the shaker preferably cooperate with an encircling rib formed at the upper edge portion of the spice shaker.

A THIRD EXAMPLE, U.S. Pat. No. 5,145,111 to Giblin teaches a carton blank and carton wherein an outer wall includes a die cut defining a cover and an inner wall disposed parallel to the cover inside the outer wall. The inner wall includes a die cut defining a removable plug. The plug is adhered to the cover so that when the consumer grasps the cover and opens it, the plug adheres to the cover and is removed from the inner wall, thereby creating a pouring opening. The plug preferably may be re-fit snugly within the pouring aperture when the cover is closed.

A FOURTH EXAMPLE, U.S. Pat. No. 5,022,566 to Song et al. teaches a one-piece side dispensing closure for powdered, granular or particulate materials. The closure is molded from plastic and has a press-open dispensing lid.

A FIFTH EXAMPLE, U.S. Pat. No. 5,452,850 to Allsop teaches a shaker type reclosable dispensing carton which includes an intermediate top closure flap having poring holes located in a depressible portion of the flap which can be depressed into the plane of an underlying flap, when the carton is reclosed, to allow a hinged outer closure flap pull-up portion to be depressed into the plane of the intermediate flap to effect a friction type locking closure between the intermediate and outer closure flaps.

A SIXTH EXAMPLE, U.S. Pat. No. 5,579,961 to Zimmerman teaches a container top including a cover with rotatable member, the rotatable member supporting a sealing member for the opening in the cover, the cover having camming member for engaging said rotatable member as the rotatable member is rotated from a sealing to an open position.

It is apparent that numerous innovations for dispensers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hand-held disposable dispenser for powder that avoids the disadvantages of the prior art.

ANOTHER OBJECT of the present invention is to provide a disposable dispenser for powder that is simple and inexpensive to manufacture.

STILL ANOTHER OBJECT of the present invention is to provide a hand-held disposable dispenser for powder that is simple to use.

BRIEFLY STATED, YET ANOTHER OBJECT of the present invention is to provide a hand-held disposable dispenser for powder that includes a container for containing the powder and a cover layer releasably attached to the container, and when opened, allowing for dispensing of the powder. The container includes a bottom layer, an intermediate layer that overlies the bottom layer, and a top layer. The top layer overlies spacingly the intermediate layer, with only the perimeter of the top layer being attached to the perimeter of the bottom layer, and thereby forms with the intermediate layer of the container, a compartment for containing the powder, and has a plurality of throughbores for dispensing the powder. The cover layer releasably overlies the plurality of throughbores in the top layer and has an adhesive layer thereon that detachably engages the top layer, a tab that extends radially therefrom for facilitating removal of the cover layer, and a string that extends along and past the tab for further facilitating removal of the cover layer, with the cover layer being removed by first grasping the string and the tab, then pulling upwardly until the cover layer is completely removed from the top layer, exposing the plurality of throughbores in the top layer, and then finally temporarily relocating the cover layer to another area of the top layer.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

First Embodiment

Figure 1:
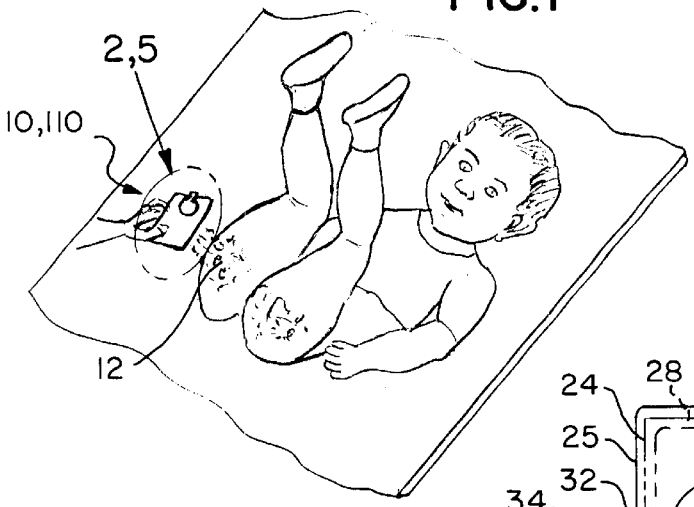
FIG. 1 is a diagrammatic perspective view of the present invention in use.

10 hand-held disposable dispenser for powder of the present invention
12 powder
14 container for containing powder 12
16 cover layer
18 bottom layer of container 14
19 perimeter of bottom layer 18 of container 14
20 intermediate layer of container 14
22 top layer of container 14
24 perimeter of top layer 22 of container 14
25 short edge of perimeter 24 of top layer 22 of container 14
26 compartment in container 14 for containing powder 12
28 plurality of throughbores in top layer 22 of container 14 for dispensing powder 12
30 adhesive layer on cover layer 16
32 tab of cover layer 16 for facilitating removal of cover layer 16
34 string of cover layer 16 for further facilitating removal of cover layer 16

Second Embodiment

110 disposable dispenser for powder of the present invention
114 container
116 cover layer
118 bottom layer of container 114
119 perimeter of bottom layer 118 of container 114
122 top layer of container 114
124 perimeter of top layer 122 of container 114
125 short edge of perimeter 124 of top layer 122 of container 114
128 plurality of throughbores in the top layer 122 of the container 114 for dispensing powder 12
132 tab of cover layer 116
134 string of cover layer 116
136 another tab of cover layer 116 for facilitating removal of cover layer 116
138 adhesive layer on another tab 136 of cover layer 116

DETAILED DESCRIPTION OF THE PREFERRED EMBODIMENT

Referring now to the figures, in which like numerals indicate like parts, and particularly to FIG. 1, the first and second embodiments of the hand-held disposable dispenser for powder of the present invention is shown generally at 10, 110, respectively, for powder 12.

Figure 2:
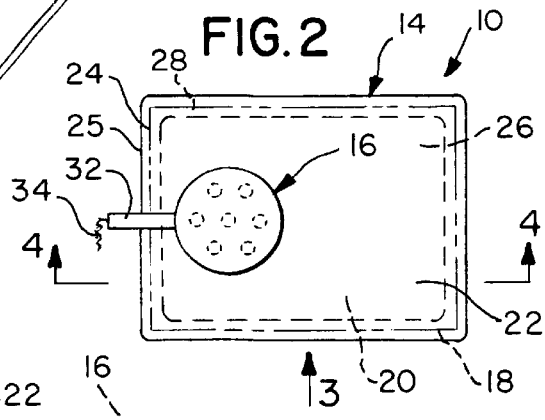
FIG. 2 is an enlarged diagrammatic top plan view of the area generally enclosed by the dotted ellipse identified by arrow 2 in FIG. 1 of a first embodiment of the present invention.
Figure 3:
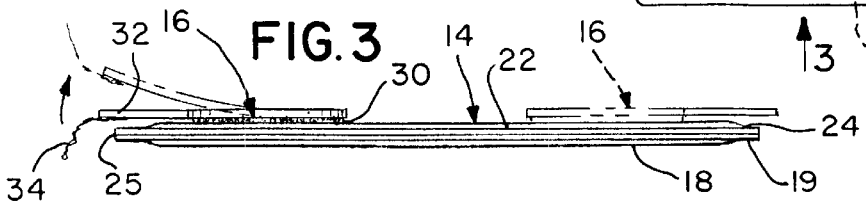
FIG. 3 is an enlarged diagrammatic side elevational view taken generally in the direction of arrow 3 in FIG. 2.
Figure 4:
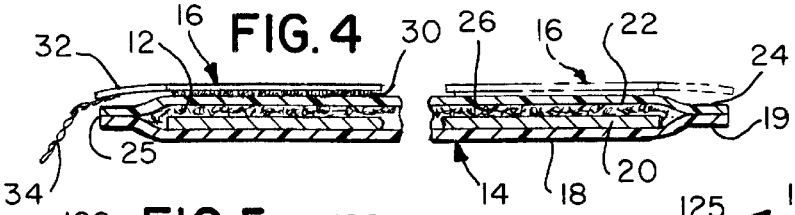
FIG. 4 is an enlarged diagrammatic cross sectional view taken on line 4—4 in FIG. 2.

The configuration of the hand-held disposable dispenser for powder 10 can best be seen in FIGS. 2–4, and as such, will be discussed with reference thereto.

The hand-held disposable dispenser for powder 10 comprises a container 14 for containing the powder 12, and a cover layer 16 releasably attached to the container 14, and when opened, allowing for dispensing of the powder 12.

The container 14 comprises a bottom layer 18 that has a perimeter 19, and is generally rectangular-shaped and made of a thin foil material.

The container 14 further comprises an intermediate layer 20 that overlies the bottom layer 18 of the container 14.

The intermediate layer 20 of the container 14 is generally rectangular-shaped and made of thin cardboard and attached to, inwardly of the perimeter 19 of, and to add rigidity for, the bottom layer 18 of the container 14.

The container 14 further comprises a top layer 22 that has a perimeter 24 with a short edge 25, and is generally rectangular-shaped and made of a thin foil material.

The top layer 22 of the container 14 overlies spacingly the intermediate layer 20 of the container 14, with only the perimeter 24 of the top layer 22 of the container 14 being attached to the perimeter 19 of the bottom layer 18 of the container 14, and thereby forms with the intermediate layer 20 of the container 14, a compartment 26 for containing the powder 12.

The top layer 22 of the container 14 has a plurality of throughbores 28 formed in a concentric circular fashion, which are disposed in close proximity to the short edge 25 of the perimeter 24 of the top layer 22 of the canister 14, and which communicate with the compartment 26 in the container 14 for dispensing the powder 12.

The cover layer 16 releasably overlies the plurality of throughbores 28 in the top layer 22 of the container 14.

The cover layer 16 is thin and circular-shaped and has an adhesive layer 30 thereon that detachably engages the top layer 22 of the container 14.

The cover layer 16 further has a tab 32 that is integral therewith and extends radially therefrom, past the short edge 25 of the top layer 24 of the container 14 for facilitating removal of the cover layer 16.

The cover layer 16 further has a string 34 that extends along and past the tab 32 of the cover layer 16 for further facilitating removal of the cover layer 16, with the cover layer 16 being removed by first grasping the string 34 of the cover layer 16 and the tab 32 of the cover layer 16, then pulling upwardly until the cover layer 16 is completely removed from the top layer 22 of the container 14, exposing the plurality of throughbores 28 in the top layer 22 of the container 14, and then finally temporarily relocating the cover layer 16 to another area of the top layer 22 of the container 14.

Figure 5:
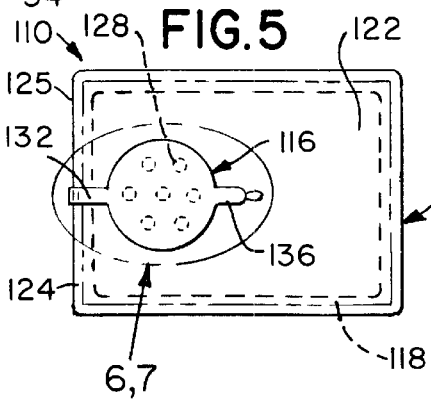
FIG. 5 is an enlarged diagrammatic top plan view of the area generally enclosed by the dotted ellipse identified by arrow 5 in FIG. 1 of a second embodiment of the present invention.
Figure 6:
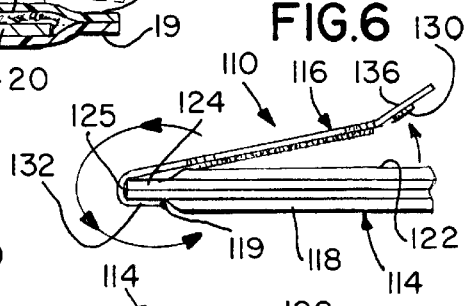
FIG. 6 is an enlarged diagrammatic side elevational view of the area generally enclosed by the dotted ellipse identified by arrow 6 in FIG. 5 of the initial step in opening the present invention.
Figure 7:
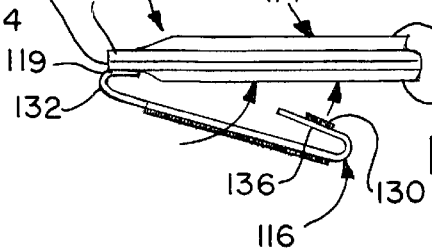
FIG. 7 is an enlarged diagrammatic side elevational view of the area generally enclosed by the dotted ellipse identified by arrow 7 in FIG. 5 of the final step in opening the present invention.

The configuration of the disposable dispenser for powder 110 can best be seen in FIGS. 5–7, and as such, will be discussed with reference thereto.

The container 114 of the disposable dispenser for powder 110 is identical to the container 14 of the disposable dispenser for powder 10.

The cover layer 116 of the disposable dispenser for powder 110 is similar to the cover layer 16 of the disposable dispenser for powder 10, except for the following:

1) The tab 132 of the cover layer 116 extends past and over the short side 125 of the perimeter 124 of the top layer 122 of the container 114 and is fixedly attached to the perimeter 119 of the bottom layer 118 of the container 114.
2) The cover layer 116 further has another tab 136 that is integral therewith and extends radially therefrom, diametrically opposite to the tab 132 of the cover layer 116, for facilitating removal of the cover layer 116.

3) The another tab 136 of the cover layer 116 has an adhesive layer 138 thereon that detachably engages the top layer 122 of the container 114.

4) The string 34 of the disposable dispenser for powder 10 is relocated to extend along and past the another tab 136 of the cover layer 116 for further facilitating removal of the cover layer 116, with the cover layer 116 being removed by first grasping the string 134 of the cover layer 116 and the another tab 136 of the cover layer 116, then pulling upwardly until the cover layer 116 clears the short edge 125 of the perimeter 125 of the top layer 122 of the container 114, exposing the plurality of throughbores 128 in the top layer 122 of the container 114, then pivoting the cover layer 116 downwardly unto the bottom layer 118 of the container 114, then finally engaging the adhesive layer 138 on the another tab 136 of the cover layer 116 with the bottom layer 118 of the container 114.

It will be understood that each of the elements described above, or two or more together, may also find a useful application in other types of constructions differing from the types described above.

While the invention has been illustrated and described as embodied in a hand-held disposable dispenser for powder, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A hand-held disposable dispenser for powder, comprising:

a) a container for containing the powder; and b) a cover layer releasably attached to said container, and when opened, allowing for dispensing of the powder, wherein said container comprises a bottom layer that has a perimeter, and is generally rectangular-shaped and made of a thin foil material, wherein said container further comprises an intermediate layer that overlies said bottom layer of said container, wherein said container further comprises a top layer that has a perimeter with a short edge, and is generally rectangular-shaped and made of a thin foil material, wherein said top layer of said container overlies spacingly said intermediate layer of said container, with only said perimeter of said top layer of said container being attached to said perimeter of said bottom layer of said container, and thereby forms with said intermediate layer of said container, a compartment for containing the powder, wherein said top layer of said container has a plurality of throughbores formed in a concentric circular fashion, which are disposed in close proximity to said short edge of said perimeter of said top layer of said canister, and which communicate with said compartment in said container for dispensing the powder, wherein said cover layer further has a tab that is integral therewith and extends radially therefrom, past said short edge of said top layer of said container for facilitating removal of said cover layer, wherein said cover layer further has a string that extends along and past said tab of said cover layer for further facilitating removal of said cover layer, with said cover layer being removed by first grasping said string of said cover layer and said tab of said cover layer, then pulling upwardly until said cover layer is completely removed from said top layer of said container, exposing said plurality of throughbores in said top layer of said container, and then finally temporarily relocating said cover layer to another area of said top layer of said container.

2. A hand-held disposable dispenser for powder, comprising:

a) a container for containing the powder; and b) a cover layer releasably attached to said container, and when opened, allowing for dispensing of the powder, wherein said container comprises a bottom layer that has a perimeter, and is generally rectangular-shaped and made of a thin foil material, wherein said container further comprises an intermediate layer that overlies said bottom layer of said container, wherein said container further comprises a top layer that has a perimeter with a short edge, and is generally rectangular-shaped and made of a thin foil material, wherein said top layer of said container overlies spacingly said intermediate layer of said container, with only said perimeter of said top layer of said container being attached to said perimeter of said bottom layer of said container, and thereby forms with said intermediate layer of said container, a compartment for containing the powder, wherein said top layer of said container has a plurality of throughbores formed in a concentric circular fashion, which are disposed in close proximity to said short edge of said perimeter of said top layer of said canister, and which communicate with said compartment in said container for dispensing the powder, wherein said cover layer has a tab that extends past and over said short side of said perimeter of said top layer of said container and is fixedly attached to said perimeter of said bottom layer of said container.

3. The dispenser as defined in claim 2, wherein said cover layer further has another tab that is integral therewith and extends radially therefrom, diametrically opposite to said tab of said cover layer, for facilitating removal of said cover layer.

4. The dispenser as defined in claim 3, wherein said another tab of said cover layer has an adhesive layer thereon that detachably engages said top layer of said container.

5. The dispenser as defined in claim 4, wherein said cover layer further has a string that extends along and past said another tab of said cover layer for further facilitating removal of said cover layer, with said cover layer being removed by first grasping said string of said cover layer and said another tab of said cover layer, then pulling upwardly until said cover layer clears said short edge of said perimeter of said top layer of said container, exposing said plurality of throughbores in said top layer of said container, then pivoting said cover layer downwardly unto said bottom layer of said container, then finally engaging said adhesive layer on said another tab of said cover layer with said bottom layer of said container.

* * * * *